US008858276B2

(12) United States Patent
Fu et al.

(10) Patent No.: US 8,858,276 B2
(45) Date of Patent: Oct. 14, 2014

(54) TERMINAL AND STRIP THEREOF WITH IMPROVED TEARING STRUCTURE

(71) Applicants: Xiao-Zhi Fu, Kunshan (CN); Ze-Lin Yao, Kunshan (CN); Zhuang-Xing Li, Kunshan (CN)

(72) Inventors: Xiao-Zhi Fu, Kunshan (CN); Ze-Lin Yao, Kunshan (CN); Zhuang-Xing Li, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 32 days.

(21) Appl. No.: 13/789,696

(22) Filed: Mar. 8, 2013

(65) Prior Publication Data

US 2013/0237104 A1 Sep. 12, 2013

(30) Foreign Application Priority Data

Mar. 8, 2012 (CN) ..... 2012 2 0084510

(51) Int. Cl.
*H01R 9/24* (2006.01)
*H01R 43/16* (2006.01)
*H01R 43/00* (2006.01)

(52) U.S. Cl.
CPC ..... *H01R 43/00* (2013.01); *H01R 43/16* (2013.01)
USPC ..... 439/885

(58) Field of Classification Search
USPC ..... 439/885, 886
See application file for complete search history.

(56) References Cited

U.S. PATENT DOCUMENTS

| | | | | |
|---|---|---|---|---|
| 6,139,377 | A * | 10/2000 | Chen | 439/885 |
| 6,196,886 | B1 * | 3/2001 | Sato | 439/885 |
| 7,744,430 | B1 * | 6/2010 | Vrenna et al. | 439/733.1 |
| 2003/0220025 | A1 * | 11/2003 | Peng et al. | 439/885 |
| 2010/0248557 | A1 * | 9/2010 | Fan | 439/816 |
| 2011/0256780 | A1 * | 10/2011 | Peng | 439/676 |

FOREIGN PATENT DOCUMENTS

| | | |
|---|---|---|
| CN | 2705928 | 1/2000 |

* cited by examiner

*Primary Examiner* — Phuong Dinh
(74) *Attorney, Agent, or Firm* — Wei Te Chung; Ming Chieh Chang

(57) ABSTRACT

A terminal strip includes a number of terminals and a strip connecting the terminals. The terminal has a body, a soldering portion extending downwardly from the body and a spring beam extending upwardly from the body. The strip has a number of slots defined during punching the soldering portion thereof. The body has a bottom edge and a connecting portion connecting with the soldering portion. A breaking cut is formed in the connecting place between the bottom edge and the strip. The breaking cut is distributed into a number of slots connecting with each other. The configuration of the breaking slot can make several slots each with a short tearing journey when the terminals are separated from the strip, that can improve the efficacy of the product yield.

3 Claims, 3 Drawing Sheets

TERMINAL AND STRIP THEREOF WITH IMPROVED TEARING STRUCTURE

BACKGROUND OF THE INVENTION

1. Field of the Invention

The present invention generally relates to a terminal and strip thereof, and more particularly to a terminal and strip with an improved tearing structure.

2. Description of Related Art

Electronic systems, such as computer systems, in order to meet the technical trend of today's computer miniaturization, a plurality of contacts assembled in the computer systems should be arranged compactness. Generally, the contacts usually are punched from a strip and are separated from the strip after being assembled to a connector. China patent issue No. CN2705928Y discloses such a contact strip. The contact strip includes a strip and a number of contacts connecting with the strip. Each contact includes a body and a soldering portion extending forwardly toward the strip from a middle of a bottom edge of the body. A connecting portion is formed between the bottom edge of the body and the strip and defines a V cut. The V cut is shown in a line used for breaking off the contacts from the strip. However, if a thickness of the contact is too thick, while the V cut is too shallow, the contacts may cause metal wires or burred edges while being tore from the strip, and the metal wires may cause short circuit.

Hence, an improved terminal and strip thereof is desired to overcome the above problems.

SUMMARY OF THE INVENTION

An objector of the invention is to provide a terminal and strip thereof with an improved tearing structure.

According to one aspect of the present invention, a terminal strip comprises a plurality of terminals and a strip connecting with the terminals. Each of the terminals have a body, a soldering portion extending downwardly from a bottom end of the body and a spring beam extending upwardly from the body; wherein the strip has a plurality of slots defined during punching the soldering portion, the body has a bottom edge and a connecting portion connecting with the soldering portions, a breaking cut is formed in a conjunction place between the bottom edge of the body and the strip, the breaking cut at least comprises a first slot and a second slot located on a lower side of the first slot and staggered with the first slot, the first and second slots are parallel to each other and communicate with each other so as to divide the breaking cut into several tearing segments.

Other objects, advantages and novel features of the present invention will become more apparent from the following detailed description of the present embodiment when taken in conjunction with the accompanying drawings.

DETAILED DESCRIPTION OF THE INVENTION

Figure 1:
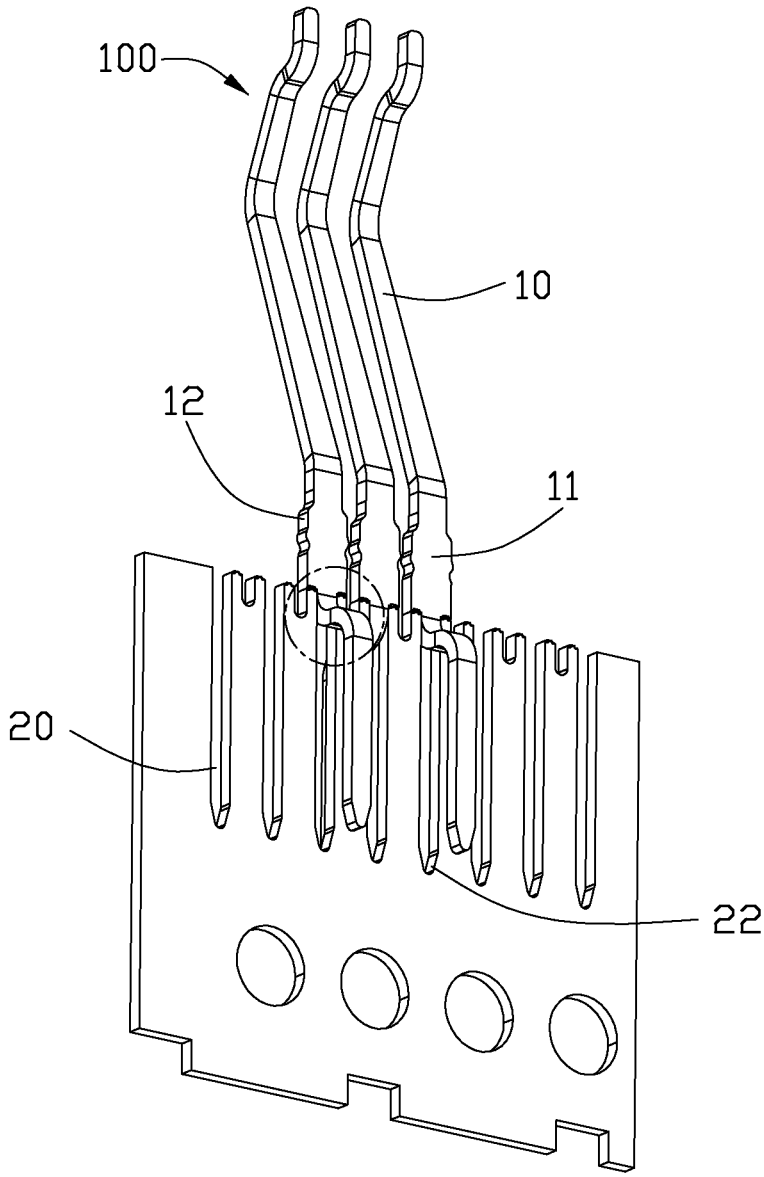
FIG. 1 is a perspective view of a terminal strip according to a preferred embodiment of the present invention.

Reference will now be made to the drawing figures to describe the preferred embodiment of the present invention in detail.

Figure 2:
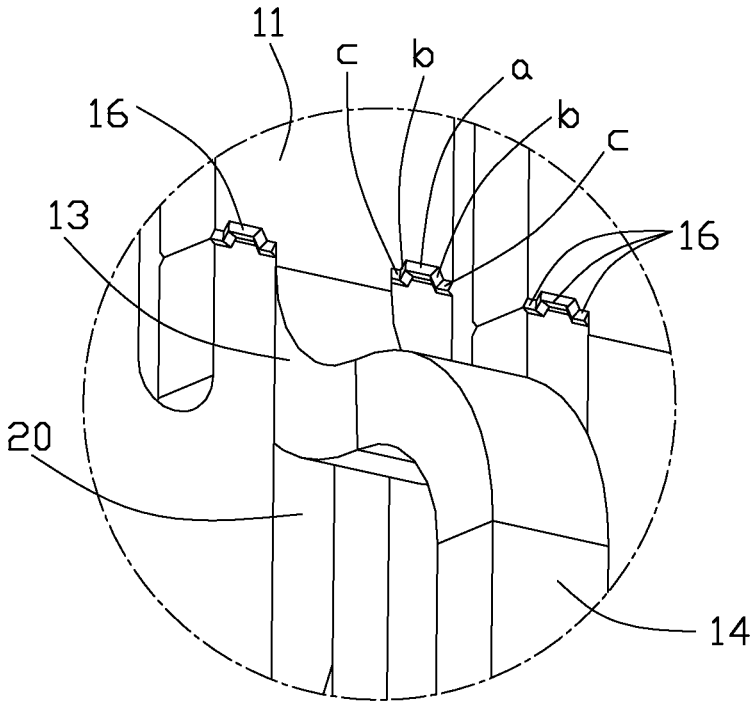
FIG. 2 is an enlarged view of the terminal strip in a circuit map of FIG. 1.
Figure 3:
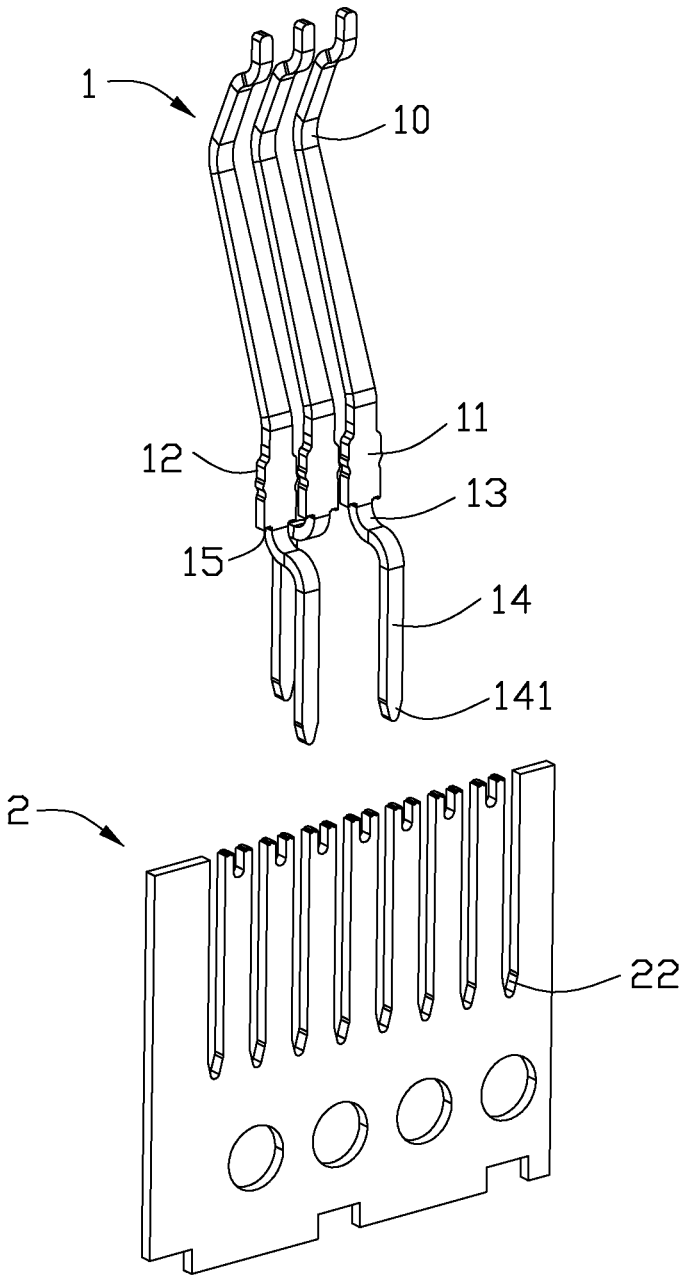
FIG. 3 is a view of a number of terminals separated from the terminal strip.

Referring to FIGS. 1-3, a terminal strip 100 including a plurality of terminals 1 and a contact strip/carrier 2 connecting with the terminals 1 together is disclosed. A number of holes (not labeled) recessed on the strip 2 to fit with an actuator (not shown) for promote the actuator.

Please referring to FIGS. 1-3, each terminal 1 has a body 11 with a plurality of lances 12 protruding out of two sides of the body 11, a resilient beam 10 extending upwardly from the body 11, a connecting portion 13 extending downwardly form a bottom end of the body 11 and bent outwardly, and a soldering portion 14 extending downwardly from a bottom end of the connecting portion 13. The connection portion 13 can make the soldering portion 14 have elastic performance.

In present invention, the body 11 has a bottom/connection edge 15 adjacent to the strip 2, the bottom edge 15 at two sides of the connecting portion 13 connecting with the strip 2. A plurality of breaking cuts 16 shaped in a V configuration are defined in a conjunction place of the bottom edge 15 and the strip 2 in a thickness direction of the strip 2. The breaking cut 16 is not a straight type but in a staggered/zigzag manner, and include a first slot a, two second slots c paralleling to the first slot a, and two third slots b aslant connecting with two opposite ends of the first slot a and the two second slots c, respectively. The two second slots c are set on a line and beside two sides of the first slot a. The first slot a is located on an upper side of the second slots c and staggered with the second slots c by the third slot b. In assembly, the breaking slot 16 is distributed into a number of parts, such as the first slot a, third slot b and the second slot c, each part has a short dimension. When the terminals 1 are separated form the strip 2, the slots a, b, c each has a shot tearing journey and can avoid metal and improve the efficacy of the product yield.

The strip 2 also forms a plurality of slots 20 by punching the soldering portions 14 thereof. Each of the soldering portions 14 has a free distal end 141 far away from the body 11. An angle in a 5-15 degrees is formed between a side edge of the free distal end 141 and a vertical direction. The slot 20 has an incline face 22 corresponding to the free distal end 141. Under this arrangement, as the terminals 1 are pulled up and down to remove from the strip 2, a distance is formed between the incline face 22 and the angle to avoid a friction between the slot 20 and the soldering portion 14. A configuration of the terminal 2 does not only limited to the present embodiment, and the soldering portion 14 also can be formed in other configurations.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A terminal strip, comprising:

a plurality of terminals, each terminal having a body, a soldering portion extending downwardly from a bottom end of the body and a spring beam extending upwardly from the body; and a strip connecting with the terminals; wherein the strip has a plurality of slots defined during punching the soldering portions, the body has a bottom edge and a connecting portion connecting with the soldering portion, a breaking cut is formed in a conjunction place between the bottom edge of the body and the strip, the breaking cut at least comprises a first slot and a second slot located on a lower side of the first slot and staggered with the first slot, the first and second slots are parallel to each other and communicate with each other so as to divide the breaking cut into several short tearing journey, wherein the breaking cut further comprises a third slot aslant connecting with the first and second slots, wherein the breaking cut has two said second slots, which are located beside two opposite sides of the first slot and are positioned in one row, and the breaking cut further comprises two said third slots connecting with the two second slots and the first slot, respectively, wherein a cross section of the breaking cut is shaped as a V configuration, wherein each of the soldering portion comprises a free distal end, an angle in a degrees is defined between a side edge of the free distal end and a vertical direction, the slot of the strip comprises an inclined face corresponding to the free distal end of the soldering portion.

2. A terminal comprising:

a body having a connection edge which is previously linked to a contact strip from which the terminal is stamped to be formed;

a soldering portion extending downwardly from a lower part of the body; and a resilient beam extending upwardly from an upper part of the body; and the connection edge of the body defining a breaking cut via which the terminal is removed from the contact strip; wherein the breaking cut extends transversely in a non-straight manner, wherein said body is planar, wherein said breaking cut extends in generally a zigzag manner, wherein said breaking cut defines at two transverse slots offset from each other in a vertical direction, wherein said breaking cut further defines a slanting slot linking said two transverse slots together, wherein the soldering portion extends from said connection edge downwardly, wherein said breaking cut extends in a staggered manner, wherein said body is planar and the breaking cut defines a V-shaped groove in a thickness direction of said body.

3. A terminal comprising:

a body defining a connection edge which is adapted to be linked to a contact strip from which said terminal is stamped to be formed;

a breaking cut extending transversely along said connection edge in generally a staggered manner; wherein through said breaking cut whereby, it is easy to break said body away from the contact strip, wherein said breaking cut defines at least two transverse slots spaced from each other in a vertical direction, wherein said breaking cut further defines an oblique slot linked between said two transverse slots, wherein said breaking cut defines a V-shaped groove along a conjunction region of the connection edge and the contact strip in a thickness direction of said body, wherein said terminal further defines a soldering portion extending downwardly from said connection edge, wherein said body extends in a planar manner, wherein breaking cut defines two transverse slots spaced transversely from each other at a same level, and one additional transverse slot spaced from said two transverse slot in a vertical direction at another level.

* * * * *